US008145476B2

(12) United States Patent
Imai

(10) Patent No.: US 8,145,476 B2
(45) Date of Patent: Mar. 27, 2012

(54) RECEIVED VOICE PLAYBACK APPARATUS

(75) Inventor: Yukihiro Imai, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 835 days.

(21) Appl. No.: 12/007,442

(22) Filed: Jan. 10, 2008

(65) Prior Publication Data

US 2008/0183464 A1 Jul. 31, 2008

(30) Foreign Application Priority Data

Jan. 30, 2007 (JP) ..... 2007-019840

(51) Int. Cl.
*G10L 19/14* (2006.01)

(52) U.S. Cl. ..... 704/205; 704/201; 704/206; 704/207; 704/208; 704/209

(58) Field of Classification Search ..... None
See application file for complete search history.

(56) References Cited

U.S. PATENT DOCUMENTS

| | | | | |
|---|---|---|---|---|
| 6,009,388 | A * | 12/1999 | Ozawa | 704/223 |
| 2001/0016045 | A1* | 8/2001 | Ohta | 381/98 |
| 2003/0021428 | A1* | 1/2003 | Abe et al. | 381/97 |
| 2005/0169488 | A1* | 8/2005 | Kato et al. | 381/98 |
| 2007/0025566 | A1* | 2/2007 | Reams | 381/98 |
| 2007/0133831 | A1* | 6/2007 | Kim et al. | 381/313 |

FOREIGN PATENT DOCUMENTS

| | | | |
|---|---|---|---|
| JP | 07-042236 | | 7/1995 |
| JP | 2001-060989 | | 3/2001 |
| JP | 2001-086200 | A | 3/2001 |
| JP | 3286924 | | 3/2002 |
| JP | 2002-223268 | A | 8/2002 |
| JP | 2006-333396 | A | 12/2006 |

* cited by examiner

*Primary Examiner* — Leonard Saint Cyr
(74) *Attorney, Agent, or Firm* — Dickstein Shapiro LLP

(57) ABSTRACT

A disclosed received voice playback apparatus includes a characteristic acquiring unit configured to acquire first frequency characteristic values obtained by resolving digital vocal signals that are based on received vocal signals into predetermined frequency bands, wherein each first frequency characteristic value corresponds to one of the predetermined frequency bands; a setting unit configured to obtain second frequency characteristic values, wherein each second frequency characteristic value is set for one of the predetermined frequency bands; a computing unit configured to compute a gain for each of the predetermined frequency bands based on a difference between the first frequency characteristic value and the second frequency characteristic value; and a characteristic changing unit configured to change the first frequency characteristic values of the digital vocal signals by multiplying the digital vocal signals by each of the gains corresponding to one of the predetermined frequency bands of the digital vocal signals.

8 Claims, 2 Drawing Sheets

RECEIVED VOICE PLAYBACK APPARATUS

BACKGROUND OF THE INVENTION

1. Field of the Invention

The present invention relates to a received voice playback apparatus.

2. Description of the Related Art

Conventionally, there is a technology applied to a communications terminal for converting a received voice signal into a voice (sound) that can be clearly heard by the operator, and outputting the converted voice. For example, Japanese Patent No. 3286924 (Patent Document 1) discloses a technology applied to a mobile communications terminal provided with a function of adjusting frequency sensitivity characteristics of received vocal signals. According to patent document 1, a digital filter is used for adjusting frequency sensitivity characteristics. Plural types of tap coefficients, which are used for setting characteristics of the digital filter, are provided beforehand. Accordingly, even if the mobile communications terminal is used outdoors where the ambient noise is high, or even if the mobile communications terminal is used by an elderly person who has difficulty in hearing, it will be possible to make adjustments in such a manner that the original voice of the received signal is reproduced to be a clear, easy-to-hear voice.

Patent Document 1: Japanese Patent No. 3286924

However, the technology applied to the mobile communications terminal disclosed in Patent Document 1 involves the process of setting in advance the coefficient values that are multiplied by each frequency. Therefore, if an inappropriate coefficient value is set for the received voice signal, there will be cases where the output voice is hard to hear by the operator of the mobile communications terminal.

For example, in a case where an output value corresponding to a high frequency of a received voice signal is large, if a coefficient has been set such that the high frequency of the received voice signal is to be emphasized, the output voice will be hard to hear.

SUMMARY OF THE INVENTION

The present invention provides a received voice playback apparatus in which one or more of the above-described disadvantages are eliminated.

A preferred embodiment of the present invention provides a received voice playback apparatus capable of outputting a clear voice regardless of the frequency characteristics of the received voice.

An embodiment of the present invention provides a received voice playback apparatus including a characteristic acquiring unit configured to acquire first frequency characteristic values obtained by resolving digital vocal signals that are based on received vocal signals into predetermined frequency bands, wherein each first frequency characteristic value corresponds to one of the predetermined frequency bands; a setting unit configured to obtain second frequency characteristic values, wherein each second frequency characteristic value is set for one of the predetermined frequency bands; a computing unit configured to compute a gain for each of the predetermined frequency bands based on a difference between the first frequency characteristic value and the second frequency characteristic value; and a characteristic changing unit configured to change the first frequency characteristic values of the digital vocal signals by multiplying the digital vocal signals by each of the gains corresponding to one of the predetermined frequency bands of the digital vocal signals.

According to one embodiment of the present invention, a received voice playback apparatus is provided, which is capable of outputting a clear voice regardless of the frequency characteristics of a received voice signal.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

Figure 1:
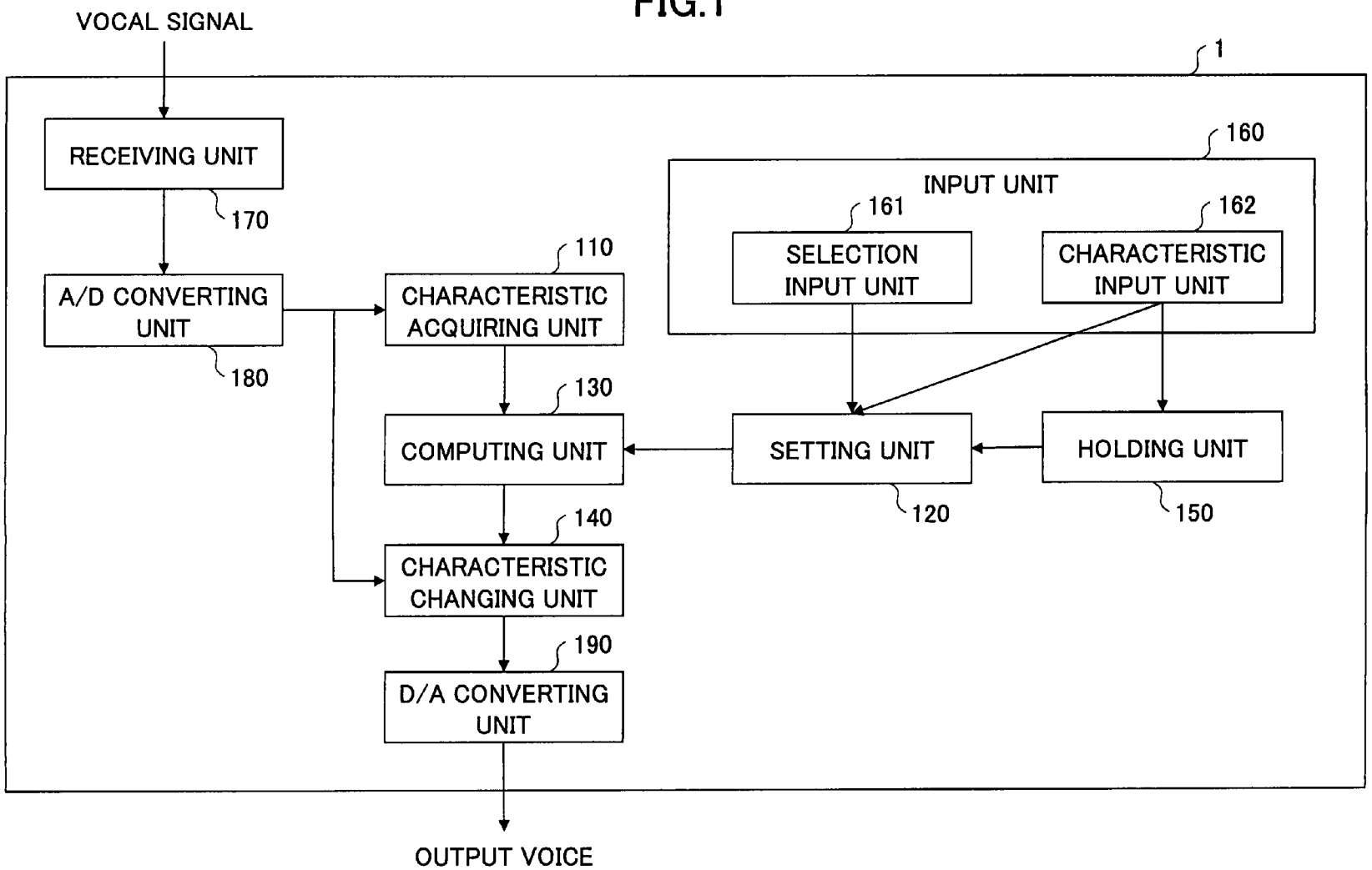
FIG. 1 illustrates a functional configuration of a received voice playback apparatus according to an embodiment of the present invention.

FIG. 1 illustrates a functional configuration of a received voice playback apparatus 1 according to an embodiment of the present invention. The received voice playback apparatus 1 shown in FIG. 1 receives vocal signals, appropriately converts the frequency characteristics of the vocal signals, and then outputs the converted vocal signals as voice (sound signals). The received voice playback apparatus 1 includes a characteristic acquiring unit 110, a setting unit 120, a computing unit 130, and a characteristic changing unit 140. The received voice playback apparatus 1 further includes a holding unit 150, an input unit 160, a receiving unit 170, an analog-digital (hereinafter, "A/D") converting unit 180, and a digital-analog (hereinafter, "D/A") converting unit 190.

The characteristic acquiring unit 110 acquires frequency characteristics of vocal signals received by the received voice playback apparatus 1. For example, the characteristic acquiring unit 110 can acquire the level of the digital vocal signal of each predetermined frequency band as the frequency characteristics of vocal analog signals converted into digital signals. Furthermore, the characteristic acquiring unit 110 can acquire the frequency characteristics of vocal analog signals at predetermined time intervals by performing a frequency resolution process such as discrete Fourier transformation or an accelerated algorithm thereof such as high-speed Fourier transformation.

The setting unit 120 is for setting an appropriate frequency characteristic value that is requested by the operator. The frequency characteristic value set by the setting unit 120 can be, for example, the level of the digital vocal signal of each predetermined frequency band. Based on the frequency characteristic set by the setting unit 120, the computing unit 130 or the characteristic changing unit 140 described below changes the frequency characteristic value of the vocal signal output by the received voice playback apparatus 1. The frequency characteristic set by the setting unit 120 can be, for example, the frequency characteristic of the vocal signal output by the received voice playback apparatus 1.

For example, if a process is to be performed according to a ratio of a difference computed by the computing unit 130 described below, the setting unit 120 will set the ratio as the frequency characteristic.

The computing unit 130 obtains the difference between a value of a frequency characteristic acquired by the characteristic acquiring unit 110 (hereinafter, "first frequency characteristic") and a value of a frequency characteristic acquired by the setting unit 120 (hereinafter, "second frequency characteristic"). Then, based on the obtained difference, the computing unit 130 obtains a gain with which the characteristic changing unit 140 changes the frequency characteristic of the digital vocal signal to a predetermined frequency characteristic selected by a selection input unit 161. The gain obtained by the computing unit 130 is determined such that the frequency characteristic of the digital vocal signal becomes the same as the second frequency characteristic.

If all of the vocal sound signals output by the received voice playback apparatus 1 have the second frequency characteristic, the following problem may occur. That is, human voices, which are supposed to be different for every individual, will all have the same frequency characteristic. Hence, it will be difficult for the person listening to the vocal sound signals to distinguish whose voice is being received. Accordingly, the gain obtained by the computing unit 130 can be the ratio of a value of the first frequency characteristic to a value obtained by adding together a value corresponding to 50% of the difference (between the first frequency characteristic and the second frequency characteristic) with the value of the first frequency characteristic. Accordingly, the vocal signals output by the received voice playback apparatus 1 will incorporate the first frequency characteristic, so that the listener can distinguish the frequency characteristics of human voices that are different for every individual. The percentage of the difference to be added to the value of the first frequency characteristic does not necessarily have to be 50%; for example, the percentage can be set by the setting unit 120.

The characteristic changing unit 140 changes the frequency characteristic of the digital vocal signal based on the gain computed by the computing unit 130. The characteristic changing unit 140 changes the frequency characteristic by performing, for example, a digital filtering process on the digital vocal signal.

The holding unit 150 holds the value of the second frequency characteristic set by the setting unit 120. The holding unit 150 can hold plural second frequency characteristic values, and output, to the setting unit 120, one of the held second frequency characteristic values based on an instruction input by the input unit 160 described below.

The second frequency character value held by the holding unit 150 can include a small amount of high-frequency components and a large amount of low-frequency components, such as a value corresponding to a frequency characteristic for elderly people.

The input unit 160 receives input instructions for processes to be performed by the received voice playback apparatus 1. The input unit 160 includes the selection input unit 161 and/or a characteristic input unit 162. The selection input unit 161 selects a second frequency characteristic value to be set by the setting unit 120, from among the plural second frequency characteristic values held by the holding unit 150.

The received voice playback apparatus 1 can include a display unit for displaying a page of a list of second frequency characteristic values or a page prompting input of a selection of one of the second frequency characteristic values, which the operator uses when inputting information with the selection input unit 161. The received voice playback apparatus 1 can also include a page generating unit for generating the page of the list or the page for prompting input.

The characteristic input unit 162 is used for inputting the second frequency characteristic value. The received voice playback apparatus 1 can include a display unit for displaying a page prompting input of a second frequency characteristic value, which the operator uses when inputting information with the characteristic input unit 162. The received voice playback apparatus 1 can also include a page generating unit for generating the page for prompting input.

The second frequency characteristic value input with the characteristic input unit 162 can be set by the setting unit 120; the second frequency characteristic value can be held by the holding unit 150, selected, and then set by the setting unit 120.

The receiving unit 170 is for receiving vocal signals. If the vocal signals received by the receiving unit 170 are analog signals, the A/D converting unit 180 converts the vocal signals into digital vocal signals.

The D/A converting unit 190 is for converting digital vocal signals, whose frequency characteristics have been changed by the characteristic changing unit 140, into analog signals. When the vocal signals converted by the D/A converting unit 190 are output from the received voice playback apparatus 1, the operator can hear voice (sound).

The characteristic acquiring unit 110, etc., in FIG. 1 perform processes on digital vocal signals; however, an embodiment of the present invention is not limited to the example shown in FIG. 1, and processes can be performed on analog vocal signals.

(Example of Digital Mobile Phone Receiving Apparatus)

Figure 2:
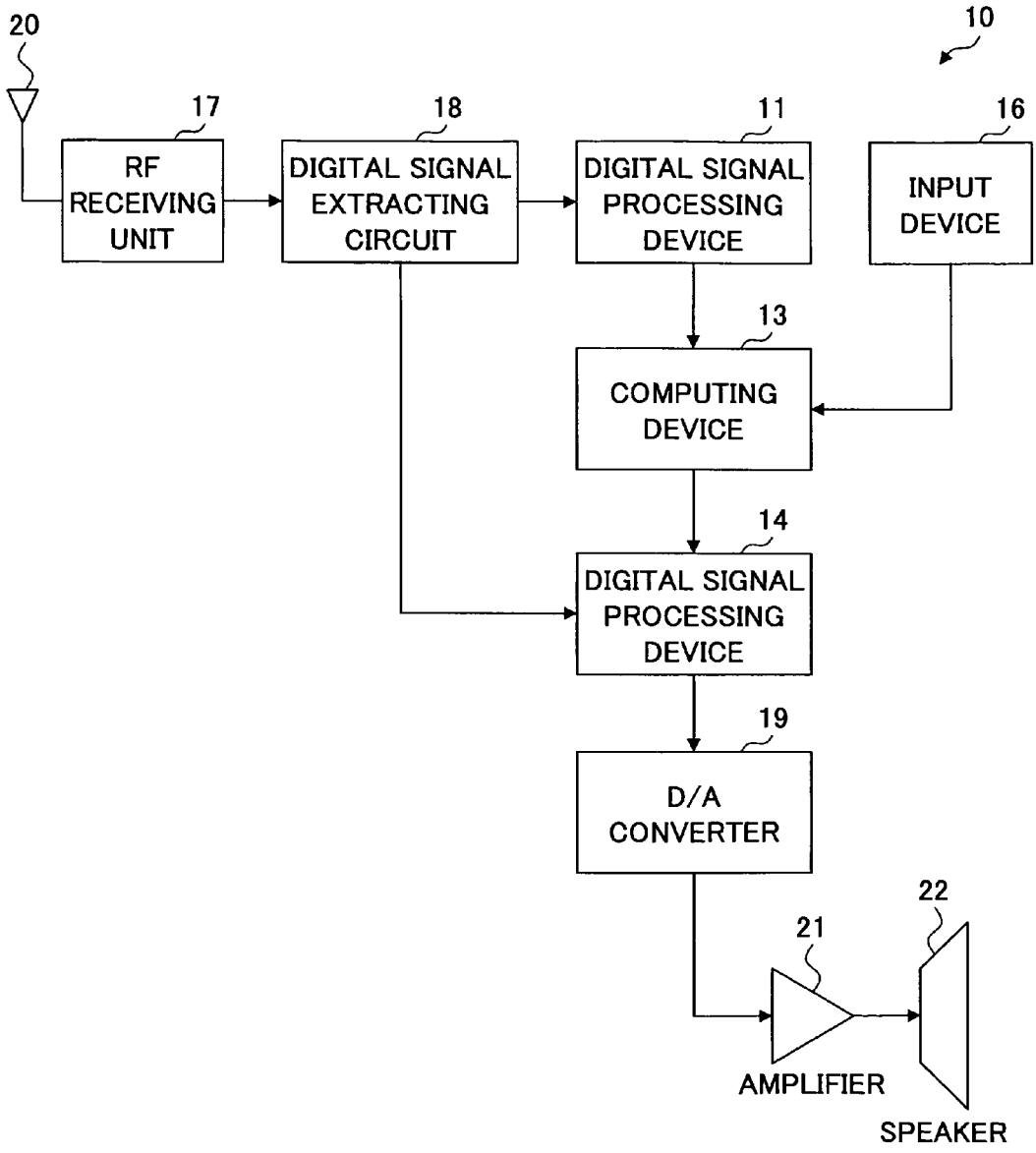
FIG. 2 illustrates a digital mobile phone receiving apparatus having the functional configuration of the received voice playback apparatus according to an embodiment of the present invention.

FIG. 2 illustrates a digital mobile phone receiving apparatus 10 having the functional configuration shown in FIG. 1. The digital mobile phone receiving apparatus 10 shown in FIG. 2 includes an antenna 20, an RF (Radio Frequency) receiving unit 17, a digital signal extracting circuit 18, a digital signal processing device 11, a computing device 13, a digital signal processing device 14, an input device 16, a D/A converter 19, an amplifier 21, and a speaker 22.

The antenna 20 is for receiving radio waves, and the RF receiving unit 17 is for acquiring analog vocal signals from the radio waves received by the antenna 20. The digital signal extracting circuit 18 is for extracting digital vocal signals by performing sampling at predetermined intervals on the analog vocal signals acquired by the RF receiving unit 17.

The digital signal processing device 11 acquires frequency characteristics of digital vocal signals extracted by the digital signal extracting circuit 18. The digital signal processing device 11 performs frequency resolution on the digital vocal signals by a digital filtering process such as discrete Fourier transformation, to thereby acquire frequency characteristics of the digital vocal signals. The digital signal extracting circuit 18 and the digital signal processing device 11 can be configured to be a single circuit or a single device. Accordingly, it could be possible to reduce delays in the transmission of signals and to reduce buffers used for temporarily holding signals.

The input device 16 is used for inputting a frequency characteristic value pertinent to a vocal signal output by the digital mobile phone receiving apparatus 10.

The computing device 13 obtains the difference between a frequency characteristic value of a digital vocal signal acquired by the digital signal processing device 11 and a frequency characteristic value input with the input device 16. Furthermore, based on the computed difference, the computing device 13 can compute the correction amount for a correction process on the digital vocal signals performed by the digital signal processing device 14.

The correction amount can be a value for correcting all of the computed differences or a value for correcting some of the computed differences. The correction amount can be a gain corresponding to the ratio of a frequency characteristic value of a digital vocal signal before correction to a frequency characteristic value of a digital vocal signal after correction.

The digital signal processing device 14 applies the correction amount computed by the computing device 13 to the digital vocal signals. For example, the digital signal processing device 14 performs a digital filtering process on the digital vocal signals to make corrections. The coefficients of the digital filter are values computed by the computing device 13.

The D/A converter 19 is for converting digital vocal signals corrected by the digital signal processing device 14 into analog vocal signals. The analog vocal signals output by the D/A converter 19 are amplified by the amplifier 21 and then output from the speaker 22 as voice (sound). The amplifier 21 can be integrated with the digital signal processing device 14 as a single device. In this case, in the digital signal processing device 14, the gain of the amplifier 21 is added to the gain of each frequency band.

(Realization by Computer)

The received voice playback apparatus 1 or elements thereof can be realized by, for example, a personal computer (PC). The operational processes of the above-described embodiment can be executed or processed by a CPU in accordance with a program stored in a ROM or a hard disk device and with the use of a main memory such as RAM as a work area.

According to one embodiment of the present invention, a received voice playback apparatus includes a characteristic acquiring unit configured to acquire first frequency characteristic values obtained by resolving digital vocal signals that are based on received vocal signals into predetermined frequency bands, wherein each first frequency characteristic value corresponds to one of the predetermined frequency bands; a setting unit configured to obtain second frequency characteristic values, wherein each second frequency characteristic value is set for one of the predetermined frequency bands; a computing unit configured to compute a gain for each of the predetermined frequency bands based on a difference between the first frequency characteristic value and the second frequency characteristic value; and a characteristic changing unit configured to change the first frequency characteristic values of the digital vocal signals by multiplying the digital vocal signals by each of the gains corresponding to one of the predetermined frequency bands of the digital vocal signals.

Accordingly, a received voice playback apparatus can be provided, which is capable of outputting a clear voice (sound) regardless of the frequency characteristics of the received voice signals.

Additionally, according to one embodiment of the present invention, in the received voice playback apparatus, the first frequency characteristic values include levels of the digital vocal signals in respective ones of the predetermined frequency bands, acquired within a certain band of frequencies.

Accordingly, it is possible to change the frequency characteristics of the received voice to be output by setting the gain based on the level of the digital vocal signals in respective ones of the predetermined frequency bands.

Additionally, according to one embodiment of the present invention, the received voice playback apparatus further includes a holding unit configured to hold, for each of the predetermined frequency bands, plural of the second frequency characteristic values that are different from one another, wherein the setting unit obtains one second frequency characteristic value from among the plural second frequency characteristic values held by the holding unit.

Accordingly, it is possible to select and set a preferable frequency characteristic by holding beforehand plural values of the frequency characteristic.

Additionally, according to one embodiment of the present invention, the received voice playback apparatus further includes a selection input unit configured to obtain a selection input for the one second frequency characteristic value to be set by the setting unit.

Accordingly, the operator can select a preferable frequency characteristic.

Additionally, according to one embodiment of the present invention, the received voice playback apparatus further includes a characteristic input unit configured to obtain an input of the second frequency characteristic values.

Accordingly, the operator can input a preferable value of the frequency characteristic.

Additionally, according to one embodiment of the present invention, in the received voice playback apparatus, the computing unit computes the gain corresponding to a value lying between the first frequency characteristic value and the second frequency characteristic value.

Accordingly, it is possible to output vocal signals including frequency characteristics of the input vocal signals that have been received.

The present invention is not limited to the specifically disclosed embodiment, and variations and modifications may be made without departing from the scope of the present invention.

The present application is based on Japanese Priority Patent Application No. 2007-019840, filed on Jan. 30, 2007, the entire contents of which are hereby incorporated by reference.

What is claimed is:

1. A received voice playback apparatus comprising:

a characteristic acquiring unit configured to acquire first frequency characteristic values obtained by resolving one set of digital vocal signals that are based on one set of received vocal signals into predetermined frequency bands, wherein each first frequency characteristic value corresponds to one of the predetermined frequency bands;

a setting unit configured to obtain second frequency characteristic values, wherein each second frequency characteristic value is set for one of the predetermined frequency bands;

a processor, including a computing unit configured to compute a gain for each of the predetermined frequency bands based on a difference between the first frequency characteristic value and the second frequency characteristic value; and a characteristic changing unit configured to change the first frequency characteristic values of the one set of digital vocal signals by multiplying the one set of digital vocal signals by each of the gains corresponding to one of the predetermined frequency bands of the one set of digital vocal signals.

2. The received voice playback apparatus according to claim 1, wherein: the first frequency characteristic values comprise levels of the one set of digital vocal signals in respective ones of the predetermined frequency bands, acquired within a certain band of frequencies.

3. The received voice playback apparatus according to claim 1, further comprising: a holding unit configured to hold, for each of the predetermined frequency bands, plural of the second frequency characteristic values that are different from one another, wherein: the setting unit obtains one of the second frequency characteristic values from among the plural second frequency characteristic values held by the holding unit.

4. The received voice playback apparatus according to claim 3, further comprising: a selection input unit configured to obtain a selection input for said one of the second frequency characteristic values to be set by the setting unit.

5. The received voice playback apparatus according to claim 1, further comprising: a characteristic input unit configured to obtain an input of the second frequency characteristic values.

6. The received voice playback apparatus according to claim 1, wherein: the computing unit computes the gain corresponding to a value lying between the first frequency characteristic value and the second frequency characteristic value.

7. A received voice playback device implemented by executing a program stored on a non-transitory computer readable medium, the device comprising:

a characteristic acquiring unit configured to acquire first frequency characteristic values obtained by resolving one set of digital vocal signals that are based on one set of received vocal signals into predetermined frequency bands, wherein each first frequency characteristic value corresponds to one of the predetermined frequency bands;

a setting unit configured to obtain second frequency characteristic values, wherein each second frequency characteristic value is set for one of the predetermined frequency bands;

a processor, including a computing unit configured to compute a gain for each of the predetermined frequency bands based on a difference between the first frequency characteristic value and the second frequency characteristic value; and a characteristic changing unit configured to change the first frequency characteristic values of the one set of digital vocal signals by multiplying the one set of digital vocal signals by each of the gains corresponding to one of the predetermined frequency bands of the one set of digital vocal signals.

8. The received voice playback apparatus according to claim 1, further comprising: a digital-analog converting unit configured to convert the one set of digital vocal signals into one set of analog vocal signals that is output from a single speaker.

* * * * *